US011339749B2

(12) United States Patent
Yoshioka

(10) Patent No.: US 11,339,749 B2
(45) Date of Patent: May 24, 2022

(54) ENGINE EGR DEVICE

(71) Applicant: AISAN KOGYO KABUSHIKI KAISHA, Obu (JP)

(72) Inventor: Mamoru Yoshioka, Nagoya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 17/427,027

(22) PCT Filed: Jan. 10, 2020

(86) PCT No.: PCT/JP2020/000547
§ 371 (c)(1),
(2) Date: Jul. 29, 2021

(87) PCT Pub. No.: WO2020/170641
PCT Pub. Date: Aug. 27, 2020

(65) Prior Publication Data

US 2022/0099053 A1 Mar. 31, 2022

(30) Foreign Application Priority Data

Feb. 19, 2019 (JP) ..... JP2019-027413

(51) Int. Cl.
*F02M 26/49* (2016.01)
*F02D 41/00* (2006.01)
(Continued)

(52) U.S. Cl.
CPC ..... *F02M 26/49* (2016.02); *F02D 41/0002* (2013.01); *F02M 26/14* (2016.02); *F02M 26/17* (2016.02)

(58) Field of Classification Search
CPC ..... F02M 26/49
See application file for complete search history.

(56) References Cited

U.S. PATENT DOCUMENTS 5,103,655 A * 4/1992 Kano ..... F02M 26/60 73/114.74
5,150,695 A * 9/1992 Kondo ..... F02M 26/49 123/568.16
(Continued)

FOREIGN PATENT DOCUMENTS

JP 2009-185732 A 8/2009
JP 2012-092677 A 5/2012
(Continued)

OTHER PUBLICATIONS

Feb. 25, 2020 International Search Report issued in International Patent Application No. PCT/JP2020/000547.
(Continued)

*Primary Examiner* — Phutthiwat Wongwian
*Assistant Examiner* — Arnold Castro
(74) *Attorney, Agent, or Firm* — Oliff PLC

(57) ABSTRACT

An EGR device is provided with: an EGR passage for allowing a portion of exhaust gas from an engine to flow to an intake passage; an EGR valve for adjusting an EGR flow rate through the EGR passage; a throttle valve provided in the intake passage; and an electronic control device which calculates a fully closed reference intake pressure based on an operating state of the engine during EGR valve fully-closing, and which diagnoses an abnormality due to valve-opening locking of the EGR valve based on the calculated fully closed reference intake pressure. The ECU determines a foreign matter biting abnormality of the EGR valve based on the intake pressure, and based on the result of adding the fully closed reference intake pressure, calculated according to the rotational speed and the load of the engine, to an intake-pressure increase allowance calculated according to the rotational speed.

5 Claims, 8 Drawing Sheets

(51) Int. Cl.
*F02M 26/14* (2016.01)
*F02M 26/17* (2016.01)

(56) References Cited

U.S. PATENT DOCUMENTS 5,257,610 A * 11/1993 Ohuchi ..... F02M 26/49 123/568.16
5,309,887 A * 5/1994 Kondo ..... F02M 26/57 123/568.16
5,508,926 A * 4/1996 Wade ..... F02D 41/221 123/568.16
5,542,400 A * 8/1996 Matsumoto ..... F02M 26/49 123/568.16
5,621,167 A * 4/1997 Fang-Cheng ..... F02M 26/49 123/568.16
5,632,257 A * 5/1997 Machida ..... F02D 35/023 123/435
5,635,633 A * 6/1997 Kadota ..... F02D 41/22 123/520
5,675,080 A * 10/1997 Wada ..... F02M 26/49 73/114.74
5,943,999 A * 8/1999 Yoshihara ..... F02M 26/57 123/568.16
6,390,077 B1 * 5/2002 Simpson ..... F02M 26/49 123/568.16
6,837,226 B2 * 1/2005 Wang ..... F02M 26/48 123/568.16
7,448,459 B2 * 11/2008 Kitajima ..... B60K 6/485 180/65.26
9,010,113 B2 * 4/2015 Harima ..... F02M 26/06 60/605.2
10,066,584 B2 * 9/2018 Nakano ..... F02D 41/145
2001/0053954 A1 * 12/2001 Kawaguchi ..... F02B 47/08 701/104
2002/0015669 A1 * 2/2002 Hashimoto ..... F02D 41/028 422/171
2002/0139357 A1 * 10/2002 Kawaguchi ..... F02D 41/0055 123/568.21
2005/0210970 A1 * 9/2005 Terada ..... F02D 41/222 73/114.76
2006/0272625 A1 * 12/2006 Wang ..... F02B 29/0406 123/568.16
2008/0202482 A1 8/2008 Furuta et al.
2012/0210987 A1 8/2012 Miyashita et al.
2013/0298654 A1 * 11/2013 Heinkele ..... F02M 26/49 73/114.74
2013/0312719 A1 * 11/2013 Mikashima ..... F02D 41/0055 123/568.21
2013/0319383 A1 * 12/2013 Yoshioka ..... F02D 41/123 123/568.21
2014/0137844 A1 * 5/2014 Yoshioka ..... F02D 41/107 123/568.19
2014/0298801 A1 * 10/2014 Akita ..... F02D 41/005 60/602
2015/0198102 A1 * 7/2015 Nakamura ..... F02D 41/12 60/605.2
2016/0146137 A1 * 5/2016 Hagari ..... F02D 41/0002 123/350
2018/0106220 A1 * 4/2018 Yoshioka ..... F16K 1/2021
2018/0128192 A1 * 5/2018 Sugiyama ..... F02M 26/02
2018/0283326 A1 * 10/2018 Miura ..... F02M 26/52

FOREIGN PATENT DOCUMENTS

JP 2013-083249 A 5/2013
JP 6071799 B2 2/2017
JP 2017-172573 A 9/2017
JP 2018-168816 A 11/2018

OTHER PUBLICATIONS

Dec. 8, 2020 International Preliminary Reporton Patentability issued in International Patent Application No. PCT/JP2020/000547.
Feb. 28, 2022 Office Action issued in Indian Patent Application No. 202147036286.
Mar. 22, 2022 Office Action issued in Japanese Patent Application No. 2019-027413.

* cited by examiner

ENGINE EGR DEVICE

CROSS-REFERENCE

This application is a US national phase application of International Application No. PCT/JP2020/000547, filed on Jan. 10, 2020, and claiming the priority of Japanese Application No. 2019-027413, filed Feb. 19, 2019, whose entire disclosures are incorporated herewith by reference.

TECHNICAL FIELD

The technique disclosed in this specification relates to an EGR device that brings a part of exhaust gas in an engine to flow as an EGR gas to an intake passage through an EGR passage and recirculates the gas to the engine, more particularly, to an EGR device of an engine configured to diagnose abnormality due to valve-opening locking in an EGR valve provided in an EGR passage.

BACKGROUND ART

Heretofore, as this type of technique, for example, the technique described in a Patent Document 1 indicated below has been known. This technique relates to a malfunction detection device for an exhaust gas recirculation (EGR) device of an engine. The engine includes an intake passage, an exhaust passage, a fuel supply member, and an intake amount regulation member provided in the intake passage. The EGR device includes an EGR passage and a motor-operated EGR valve. The EGR valve includes a valve seat, a valve element, a motor, and others. The intake passage downstream of the intake amount regulation member is provided with an intake pressure detection member to detect the intake pressure. Further, the engine is provided with a load detection member to detect an engine load. The malfunction detection device is provided with a malfunction determination member to determine malfunction (abnormality) of an EGR device based on an intake pressure which is detected according to an operation state of the EGR valve when the operation of the engine is under steady state and a predetermined determination condition is established. When the engine is under steady-state operation and the predetermined determination condition is established, the malfunction determination member compares the intake pressure detected according to the operation state of the EGR valve with a determined intake pressure which is obtained according to the predetermined determination condition, and thereby the malfunction determination member is made to determine abnormality of the EGR valve (such as foreign-matter lodging between a valve seat and a valve element). Herein, the predetermined determination condition is set such that an engine load to be detected is within a predetermined load range and a motor configuring the EGR valve is within a predetermined operation range.

RELATED ART DOCUMENTS

Patent Documents

Patent Document 1: JP Patent No. 6071799

SUMMARY OF INVENTION

Problems to be Solved by the Invention

However, the malfunction detection device described in the Patent Document 1 is premised with the steady-state operation of the engine and with establishment of the predetermined determination condition to determine abnormality in the EGR device, and thus an opportunity of abnormality determination is limited to a specified case. Further, in this malfunction detection device, a precondition for malfunction determination is set such that a predetermined load range is specified as low rotational speed with a light load of the engine and that a predetermined operation range is specified as a small open degree of the EGR valve. Therefore, the abnormality determination could be influenced by various variations and external disturbances (for example, deviation in a tappet clearance and deviation in valve opening and closing timing, air density (temperature), a PCV flow rate, an electrical load, and others), and abnormality in the small open degree of the EGR valve (such as a small-diameter foreign-matter lodging and others) could not be diagnosed when those variations and external disturbances are intended to be avoided. Further, in this malfunction detection device, the determined intake pressure obtained according to the predetermined determination condition could be influenced by changes in a rotational speed of the engine, so that the abnormality could not be detected accurately.

The present disclosure has been made in view of the above circumstances and has a purpose of providing an engine EGR device that can achieve prompt and precise diagnosis of abnormality caused by valve-opening locking in an EGR valve without limiting conditions related to an operation state of an engine and a motion state of the EGR valve to a specified condition.

Means of Solving the Problems

To achieve the above purpose, one aspect of the invention provides an EGR device comprising: an EGR passage in which a part of exhaust gas discharged from an engine to an exhaust passage flows from the exhaust passage to an intake passage as EGR gas to be recirculated in the engine; an EGR valve configured to regulate a flow rate of the EGR gas in the EGR passage; a throttle valve configured to regulate an inflow rate in the intake passage; and an EGR-valve abnormality diagnosis member configured to calculate a reference intake pressure based on an obtained operation state of the engine and to diagnose at least abnormality in the EGR valve due to valve-opening locking based on the calculated reference intake pressure during valve-closing control of the EGR valve, wherein the operation state of the engine includes an intake pressure in the intake passage downstream of the throttle valve, a rotational speed of the engine, and a load of the engine, and the EGR-valve abnormality diagnosis member is configured to calculate the reference intake pressure according to the obtained rotational speed and the obtained load, to calculate an intake-pressure increase allowance according to the obtained rotational speed, to add the calculated intake-pressure increase allowance to the calculated reference intake pressure, and to determine any one of presence and absence of the abnormality due to the valve-opening locking in the EGR valve based on an added result and the obtained intake pressure.

According to the above configuration (1), during operation of the engine, the intake-pressure increase allowance that has been calculated according to the obtained rotational speed is added to the reference intake pressure that has been calculated according to the obtained rotational speed and the obtained load, and based on an added result and the obtained intake pressure, presence or absence of abnormality due to the valve-opening locking in the EGR valve is determined.

Accordingly, the reference intake pressure according to the various operation state of the engine is calculated, and thus there is no need to limit the operation state of the engine to any specific condition such as sonic, and further there is no need to limit the operation state of the EGR valve to any specific condition in determining presence or absence of abnormality due to valve-opening locking in the EGR valve. Further, for determination of presence or absence of the abnormality due to the valve-opening locking, the intake-pressure increase allowance that is calculated according to the rotational speed of the engine is added to the reference intake pressure, and thus an increase amount of the intake pressure generated by failure of closing the EGR valve due to valve-opening locking is reflected on determination of presence or absence of the abnormality due to the valve-opening locking.

(2) To achieve the above purpose, in the above configuration (1), preferably, the EGR-valve abnormality diagnosis member is configured to calculate an open degree of the EGR valve based on the added result and the obtained intake pressure, to determine that the EGR valve causes the abnormality due to the valve-opening locking when the calculated open degree of the EGR valve is equal to or larger than any one of a predetermined value and almost zero, and to determine that the EGR valve causes no abnormality due to the valve-opening locking when the calculated open degree of the EGR valve is equal to or less than any one of the predetermined value and almost zero. Herein, "almost zero" includes zero and a value that is extremely approximated to zero.

According to the above configuration (2), in addition to the operation of the above configuration (1), the open degree of the EGR valve is calculated based on the added result of the reference intake pressure and the intake-pressure increase allowance and the obtained intake pressure, and thereby presence or absence of abnormality due to the valve-opening locking in the EGR valve is determined. Accordingly, the open degree of the EGR valve opened due to the valve-opening locking can be obtained through the determination of presence or absence of the abnormality due to the valve-opening locking.

(3) To achieve the above purpose, in the above configuration (2), preferably, the EGR-valve abnormality diagnosis member is configured to calculate a plurality of the different intake-pressure increase allowances according to a plurality of open degrees that are assumed to be caused by the valve-opening locking in the EGR valve, to compare a plurality of different added results of each of a plurality of the calculated intake-pressure increase allowances and the calculated reference intake pressures with the obtained intake pressure, and when the obtained intake pressure is determined to be equal or approximated to a plurality of the calculated added results, to obtain the open degree according to the intake-pressure increase allowance constituting the added results related to the determination as an open degree of the EGR valve.

According to the above configuration (3), in addition to the operation of the above configuration (2), on the premise that the intake-pressure increase allowance changes in accordance with changes in the open degree changed by the valve-opening locking in the EGR valve, the open degree corresponding to each of a plurality of the intake-pressure increase allowances that are assumed to suffer from the valve-opening locking is obtained as the open degree of the EGR valve. Therefore, the open degree can be obtained with less variations.

(4) To achieve the above purpose, in the above configuration (3), the EGR valve abnormality diagnosis member obtains the open degree among a plurality of the assumed open degrees by performing interpolation calculation of the obtained intake pressure between the two adjacent added results, values of which are close to each other, among a plurality of the calculated added results.

According to the above configuration (4), in addition to the operation of the above configuration (3), the open degree (an intermediate open degree) between a plurality of the assumed open degrees can be obtained by performing the interpolation calculation of the two adjacent added results, which are close to each other in their values among a plurality of the added results, and thus there is no need to retain data about the intermediate open degree in advance to calculate the intake-pressure increase allowance.

(5) To achieve the above purpose, another embodiment of the present invention provides an EGR device comprising: an EGR passage in which a part of exhaust gas discharged from an engine to an exhaust passage flows from the exhaust passage to an intake passage as EGR gas to be recirculated in the engine; an EGR valve configured to regulate a flow rate of the EGR gas in the EGR passage; a throttle valve configured to regulate an inflow rate in the intake passage; and an EGR-valve abnormality diagnosis member to calculate an open degree of the EGR valve based on an obtained operation state of the engine and to diagnose abnormality at least due to valve-opening locking in the EGR valve based on the calculated open degree during valve-closing control of the EGR valve, wherein the operation state of the engine includes an intake pressure in the intake passage downstream of the throttle valve, a rotational speed of the engine, and a load of the engine, and the EGR-valve abnormality diagnosis member is configured to calculate a reference intake pressure according to the obtained rotational speed and the obtained load, to calculate an intake-pressure increase allowance according to the obtained rotational speed, to add the calculated intake-pressure increase allowance to the calculated reference intake pressure, and to calculate the open degree of the EGR valve based on an added result and the obtained intake pressure.

According to the above configuration (5), during operation of the engine, the intake-pressure increase allowance that is calculated according to the obtained rotational speed is added to the reference intake pressure that is calculated according to the obtained rotational speed and the obtained load, and the open degree of the EGR valve is calculated based on the added result and the obtained intake pressure. Accordingly, the reference intake pressure corresponding to the various operation states of the engine is calculated, and thus when determining presence or absence of abnormality due to the valve-opening locking in the EGR valve, there is no need to limit the operation state of the engine to a specific condition such as sonic, and further there is no need to limit the operation state of the EGR valve to the specific condition. Further, when a foreign-matter diameter is larger than 0, it is assumed that occurrence of foreign-matter lodging (the valve-opening locking) is obvious, and accordingly, determination of presence or absence of abnormality due to the valve-opening locking in the EGR valve may be omitted.

Effects of the Invention

According to the above configuration (1), abnormality due to the valve-opening locking in the EGR valve can be promptly and accurately diagnosed without limiting the conditions related to the operation state of the engine and the motion state of the EGR valve to the specific condition.

According to the above configuration (2), in addition to the effect of the above configuration (1), the obtained open degree of the EGR valve can be utilized for a countermeasure control (for example, an idle-up control) to abnormality due to the valve-opening locking.

According to the above configuration (3), in addition to the effect of the above configuration (2), the open degree related to the valve-opening locking in the EGR valve can be highly accurately obtained.

According to the above configuration (4), in addition to the effect of the above configuration (3), there is no need to store data such as an intake-pressure increase allowance map corresponding to all the open degrees of the EGR valve to a memory of the EGR valve abnormality diagnosis member (electronic control unit), and thus the diagnosis member can be reduced with its burden.

According to the above configuration (5), abnormality due to the valve-opening locking in the EGR valve can be promptly and accurately diagnosed without limiting the condition related to the operation state of the engine and the motion state of the EGR valve to the specific condition.

MODE FOR CARRYING OUT THE INVENTION

First Embodiment

A first embodiment embodying an EGR device of an engine in a gasoline engine system is explained in detail below with reference to the accompanying drawings.

(Overview of Gasoline Engine System)

Figure 1:
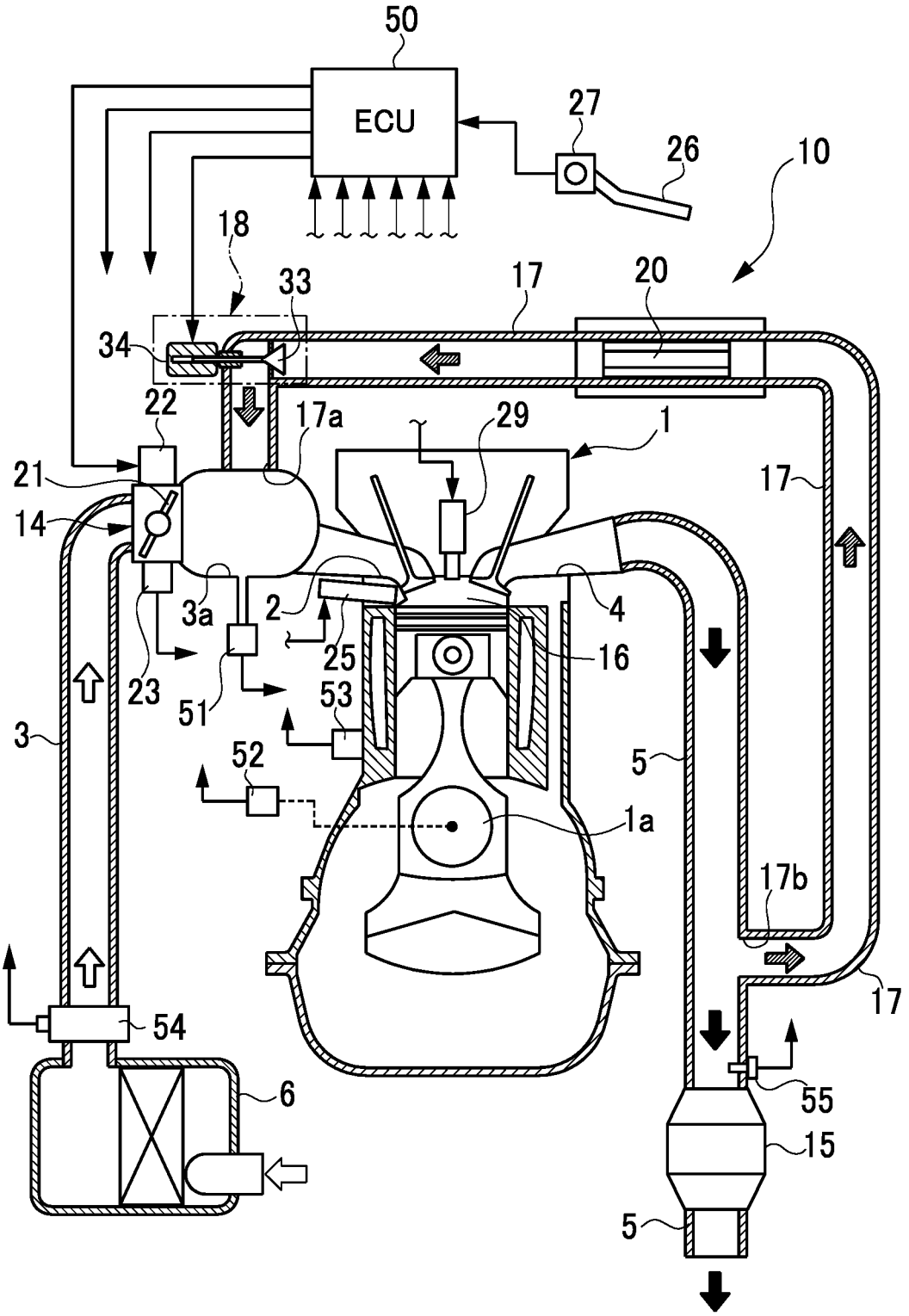
FIG. 1 is a schematic configurational view of a gasoline engine system including an EGR device of an engine in a first embodiment.

FIG. 1 is a schematic configurational view of a gasoline engine system (heretofore, simply referred as an "engine system") including an EGR device of an engine in the present embodiment. This engine system is provided with a reciprocating-type gasoline engine (heretofore, simply referred as an "engine") 1. To an intake port 2 of the engine 1, an intake passage 3 is connected, and to an exhaust port 4, an exhaust passage 5 is connected. To an inlet of the intake passage 3, an air cleaner 6 is provided.

The intake passage 3 includes a surge tank 3*a*, and in the intake passage 3 upstream of the surge tank 3*a*, an electronic throttle device 14 is provided to regulate an intake amount in the intake passage 3. This electronic throttle device 14 is provided with a throttle valve 21, a DC motor 22 to drive the throttle valve 21 to open and close, and a throttle sensor 23 to detect an open degree (a throttle open degree) TA of the throttle valve 21. The electronic throttle device 14 is made to adjust an open degree of the throttle valve 21 by driving the DC motor 22 according to driver's operation of an accelerator pedal 26. The throttle sensor 23 corresponds to one example of a load detection member to detect a throttle open degree TA corresponding to the load of the engine 1. The exhaust passage 5 is provided with a catalytic converter 15 to purify the exhaust gas.

The engine 1 is provided with an injector 25 to inject and supply fuel (gasoline) to a combustion chamber 16. To the injector 25, the fuel is to be supplied from a fuel tank (not shown). Further, the engine 1 is provided with an ignition device 29 to ignite gas mixture of the fuel and the intake air which has been formed in the combustion chamber 16.

This engine system is provided with a high-pressure loop-type EGR device 10. The EGR device 10 is a device for recirculating a part of the exhaust gas that has been discharged out of the combustion chamber 16 of the engine 1 to the exhaust passage 5 into the combustion chamber 16 as EGR gas, and the EGR device 10 is provided with an EGR passage 17 to make the EGR gas flow from the exhaust passage 5 to the intake passage 3 and an EGR valve 18 provided in the passage 17 to regulate a flow rate of the EGR gas in the EGR passage 17. The EGR passage 17 is provided between the exhaust passage 5 and the intake passage 3 (the surge tank 3*a*). Specifically, an outlet 17*a* of the EGR passage 17 is connected to the surge tank 3*a* downstream of the electronic throttle device 14. An inlet 17*b* of the EGR passage 17 is connected to the exhaust passage 5. Thus, the EGR gas flowing in the EGR passage 17 is to be introduced in the surge tank 3*a*.

The EGR passage 17 is provided with an EGR cooler 20 to cool down the EGR gas flowing in the passage 17. In the present embodiment, the EGR valve 18 is placed in the EGR passage 17 downstream of the EGR cooler 20.

(Configuration of EGR Valve)

Figure 2:
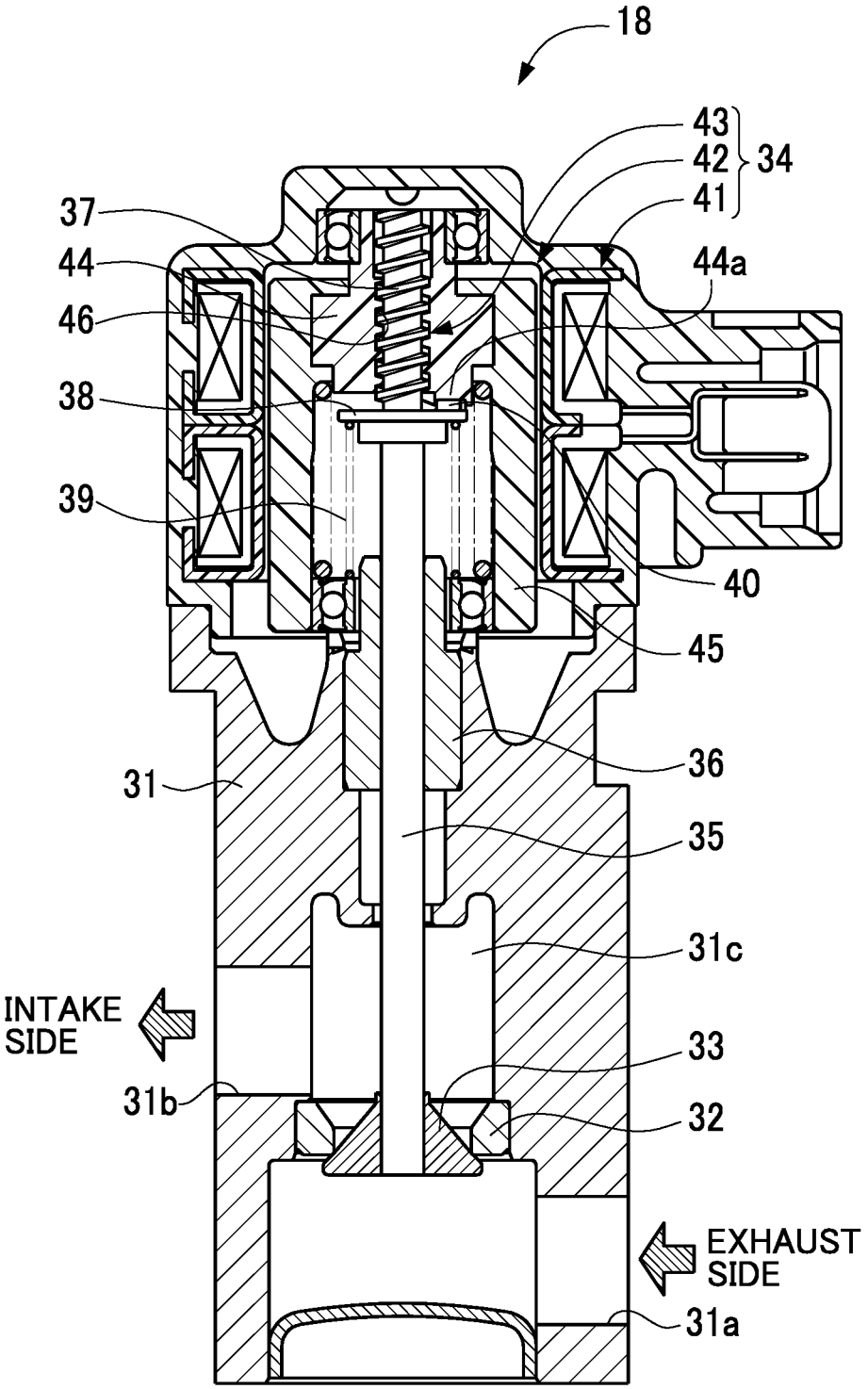
FIG. 2 is a sectional view showing a configuration of an EGR valve in the first embodiment.
Figure 3:
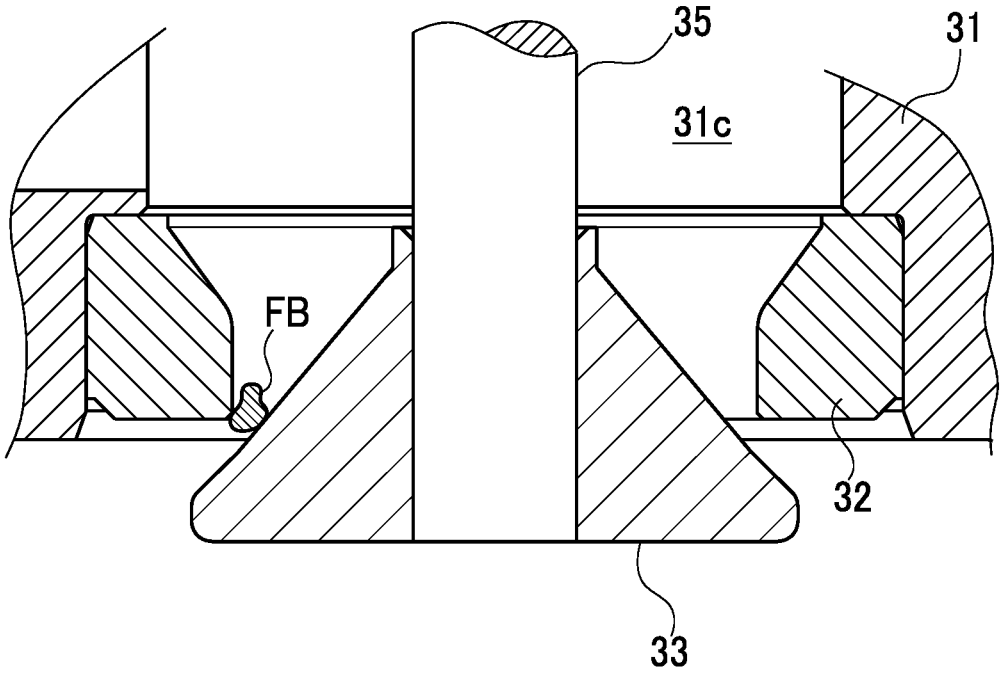
FIG. 3 is a partial enlarged sectional view of the EGR valve in the first embodiment.

FIG. 2 is a sectional view showing a configuration of the EGR valve 18. FIG. 3 is a partial enlarged sectional view of the EGR valve 18. As shown in FIG. 2, the EGR valve 18 is constituted of a poppet-type motor-operated valve. Namely, the EGR valve 18 is provided with a housing 31, a valve seat 32 provided in the housing 31, a valve element 33 provided in a seatable and movable manner with respect to the valve seat 32 in the housing 31, and a step motor 34 to drive the valve element 33 to make a stroke movement. The housing 31 includes an inflow port 31*a* to which the EGR gas is introduced from a side of the exhaust passage 5 (on an exhaust side) and an outflow port 31*b* from which the EGR gas is brought out to a side of the intake passage 3 (an intake side), and a communication passage 31*c* communicating the inflow port 31*a* and the outflow port 31*b*. The valve seat 32 is provided in a midpoint of the communication passage 31*c*.

The step motor 34 is provided with an output shaft 35 capable of making linear reciprocal movement (stroke movement), and the valve element 33 is fixed to a leading end of the output shaft 35. The output shaft 35 is supported in a manner to be able to make the stroke movement with respect to the housing 31 via a bearing 36 provided in the housing 31. On an upper end portion of the output shaft 35, a male thread portion 37 is formed. In a midpoint (in a vicinity of a lower end of the male thread portion 37) of the output shaft 35, a spring receiver 38 is formed. The spring receiver 38 has a lower surface constituted of a receiving surface for a compression spring 39 and has an upper surface formed with a stopper 40.

The valve element 33 is of a conical shape and this conical surface is made to be in and out of contact with the valve seat 32. By bringing the valve element 33 into contact with the valve seat 32, the valve element 33 is fully closed, and by bringing the valve element 33 out of contact with the valve seat 32, the valve element 33 is to be opened. The valve element 33 is arranged to be urged to a side of the step motor 34, namely in a valve closing direction to be seated on the valve seat 32 by the compression spring 39 provided between the spring receiver 38 and the housing 31. Then, when the valve element 33 in the fully closed state makes the stroke movement against the urging force of the compression spring 39 by the output shaft 35 of the step motor 34, the valve element 33 is separated from the valve seat 32 (valve opening). During this valve opening, the valve element 33 is moved to an upstream side (to the exhaust side) of the EGR passage 17. In this manner, in this EGR valve 18, the valve element 33 is moved from the fully-closed state in which the valve element 33 is seated on the valve seat 32 to the upstream side of the EGR passage 17 against the exhaust pressure or the intake pressure of the engine 1, and thus the valve element 33 is separated from the valve seat 32 to be opened. On the other hand, from the valve-open state, the valve element 33 is moved in an urging direction of the compression spring 39 by the output shaft 35 of the step motor 34, and thus the valve element 33 is brought closer to close the valve seat 32. During this valve-closing operation, the valve element 33 is moved to the downstream side (the intake side) of the EGR passage 17.

In the present embodiment, by the stroke movement of the output shaft 35 of the step motor 34, the open degree of the valve element 33 relative to the valve seat 32 is made to be adjusted. The output shaft 35 of the EGR valve 18 is provided to be able to make the stroke movement by a predetermined stroke from the valve-fully-closed state in which the valve element 33 is seated on the valve seat 32 to the valve-fully-open state in which the valve element 33 is separated most from the valve seat 32.

The step motor 34 includes a coil 41, a magnetic rotor 42, and a conversion mechanism 43. The step motor 34 is excited to rotate the magnetic rotor 42 by a predetermined number of motor steps by energization of the coil 41, and is made to convert the rotation movement of the magnetic rotor 42 into the stroke movement of the output shaft 35 by the conversion mechanism 43. In accordance with this stroke movement of the output shaft 35, the valve element 33 is arranged to make the stroke movement with respect to the valve seat 32.

The magnetic rotor 42 includes a resin-made rotor body 44 and an annular plastic magnet 45. The rotor body 44 is formed on its center with a female thread portion 46 to be threaded with a male thread portion 37 of the output shaft 35. By rotation of the rotor body 44 in a state in which the female thread portion 46 of the rotor body 44 and the male thread portion 37 of the output shaft 35 are threaded, that rotation movement is converted into the stroke movement of the output shaft 35. Herein, the male thread portion 37 and the female thread portion 46 constitute the above-mentioned conversion mechanism 43. The rotor body 44 is formed in its lower portion with a contact portion 44*a* to be in contact with the stopper 40 of the spring receiver 38. During fully closing of the EGR valve 18, an end face of the stopper 40 comes to surface contact with an end face of the contact portion 44*a* so that an initial position of the output shaft 35 is restricted.

In the present embodiment, by changing the number of motor steps of the step motor 34 stepwise, the open degree of the valve element 33 of the EGR valve 18 is made to be finely adjusted stepwise between the fully-closed position to the fully-open position.

(Electrical Configuration of Engine System)

In the present embodiment, there is provided an electronic control unit (ECU) 50 to carry out each of fuel injection control, ignition timing control, intake amount control, EGR control, and others according to the operation state of the engine 1. The ECU 50 is, according to the operation state of the engine 1, made to control each of the injector 25, the ignition device 29, the DC motor 22 of the electronic throttle device 14, and the step motor 34 of the EGR valve 18. The ECU 50 includes a central processing unit (CPU), various memories to store predetermined control programs and others in advance and to temporarily store calculation results and others of the CPU, and an external input circuit and an external output circuit which are connected to those components, respectively. The ECU 50 corresponds to one example of an EGR-valve abnormality diagnosis member of the present disclosure. Further, the ECU 50 corresponds to one example an EGR-valve control member to control the EGR valve 18. To the external output circuit, the injector 25, the ignition device 29, the electronic throttle device 14 (the DC motor 22), and the EGR valve 18 (the step motor 34) are connected. To the external input circuit, not only the throttle sensor 23 but also various sensors 27 and 51 to 55 are connected to detect the operation state of the engine 1. The various sensors 23, 27, and 51 to 55 constitute one example of an operation state detection member.

Herein, as the various sensors other than the throttle sensor 23, there are provided an accelerator sensor 27, an intake pressure sensor 51, a rotational speed sensor 52, a water temperature sensor 53, an air flow meter 54, and an air-fuel ratio sensor 55. The accelerator sensor 27 detects an operation amount of the accelerator pedal 26 as an accelerator open degree ACC and outputs its detection signal. The intake pressure sensor 51 detects the pressure of the intake air as an intake pressure PM in the intake passage 3 (the surge tank 3*a*) downstream of the electronic throttle device 14 (the throttle valve 21) in which the EGR gas flows in as an intake pressure PM and outputs its detection signal. The intake pressure sensor 51 corresponds to one example of an intake pressure detection member to detect the intake pressure. The rotational speed sensor 52 detects a rotation angle (a crank angle) of a crank shaft 1*a* of the engine 1 and changes in the crank angle as a rotational speed (the engine rotational speed) NE of the engine 1, and outputs those detection signal. The rotational speed sensor 52 constitutes one example of a rotational speed detection member to detect the rotational speed of the engine 1. The water temperature sensor 53 detects a cooling water temperature THW of the engine 1 and outputs its detection signal. The air flow meter 54 detects an intake amount Ga flowing in the intake passage 3 directly downstream of the air cleaner 6 and outputs its detection signal. The air-fuel ratio sensor 55 detects an air-fuel ratio A/F in the exhaust gas in the exhaust passage 5 directly upstream of the catalytic converter 15 and outputs its detection signal. The throttle sensor 23, the intake pressure sensor 51, the rotational speed sensor 52, or the air flow meter 54 constitute one example of a load detection member to detect the load of the engine 1.

In the present embodiment, the ECU 50 is made to control the EGR valve 18 in order to control EGR according to the operation state of the engine 1 in the entire operation region of the engine 1. On the other hand, the ECU 50 is made to control the EGR valve 18 to be fully closed to shut off EGR during deceleration of the engine 1.

Herein, as shown in FIG. 3, the EGR valve 18 has sometimes problems about the foreign-matter FB lodging and adhesion such as deposits between the valve seat 32 and the valve element 33. To address this, in the EGR device of the present embodiment, the ECU 50 is arranged to carry out "the foreign-matter lodging diagnosis control" in order to diagnose abnormality due to valve-opening locking including the foreign-matter lodging in the EGR valve 18.

(Foreign-Matter Lodging Diagnosis Control)

Figure 4:
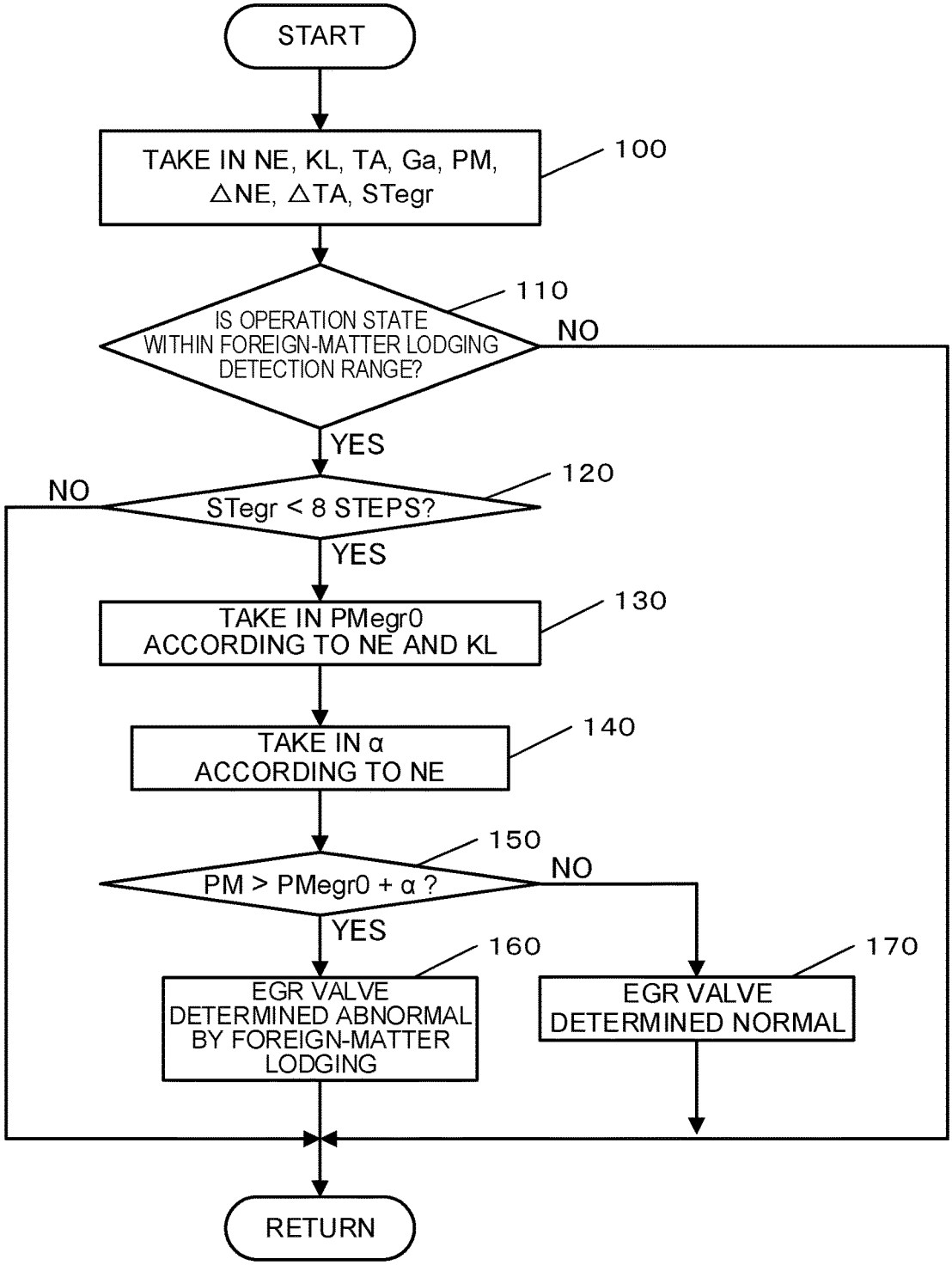
FIG. 4 is a flow chart indicating processing contents of foreign-matter lodging diagnosis control in the first embodiment.

FIG. 4 is a flow chart showing one example of processing contents of "foreign-matter lodging diagnosis control" carried out by the ECU 50. This flow chart indicates the process of diagnosing abnormality due to foreign-matter lodging (valve-opening locking) in the EGR valve 18 during deceleration of the engine 1 and when the EGR valve 18 is controlled to be fully closed or closed.

When the process proceeds to this routine, firstly in step 100, the ECU 50 takes in various signals representing the operation state of the engine 1 from the respective sensors 23, 51, 52, and 54. Specifically, the ECU 50 takes each of an engine rotational speed NE, an engine load KL, a throttle open degree TA, an intake amount Ga, an intake pressure PM, an engine rotation change ΔNE and a throttle open-degree change ΔTA, and a number of motor steps STegr of the step motor 34 corresponding to the controlled open degree of the EGR valve 18. Herein, the ECU 50 can obtain the engine load KL based on the throttle open degree TA, the intake pressure PM, the engine rotational speed NE or the intake amount Ga. The ECU 50 can obtain changes in the throttle open degree TA per unit of time as the throttle open-degree change ΔTA. The ECU 50 can obtain changes in the engine rotational speed NE per unit of time as the engine rotation change ΔNE. Herein, the number of motor steps STegr has a proportional relation to the controlled open degree (the EGR open degree) of the EGR valve 18), i.e., the open degree of the valve element 33 relative to the valve seat 32.

Subsequently, in step 110, the ECU 50 determines whether the operation state of the engine 1 is within a foreign-matter lodging detection range. The ECU 50 can, for example, determine whether the range defined by a relationship of the engine rotational speed NE and the engine load KL is within a predetermined range appropriate for the foreign-matter lodging detection. As this predetermined range, deceleration operation or steady operation of the engine 1 is included. The ECU 50 proceeds the process to step 120 when the determination result is affirmative, and returns the process to step 100 when the determination result is negative.

In step 120, the ECU 50 determines whether the number of motor steps STegr is less than "8 steps". This "8 steps" is one example and corresponds to a minute open degree of the EGR valve 18. Herein, a case in which the number of motor steps STegr is "8 steps or less" corresponds to the fully-closing control of the EGR valve 18. The ECU 50 proceeds the process to step 130 when this determination result is affirmative, and returns the process to step 100 when the determination result is negative.

Figure 5:
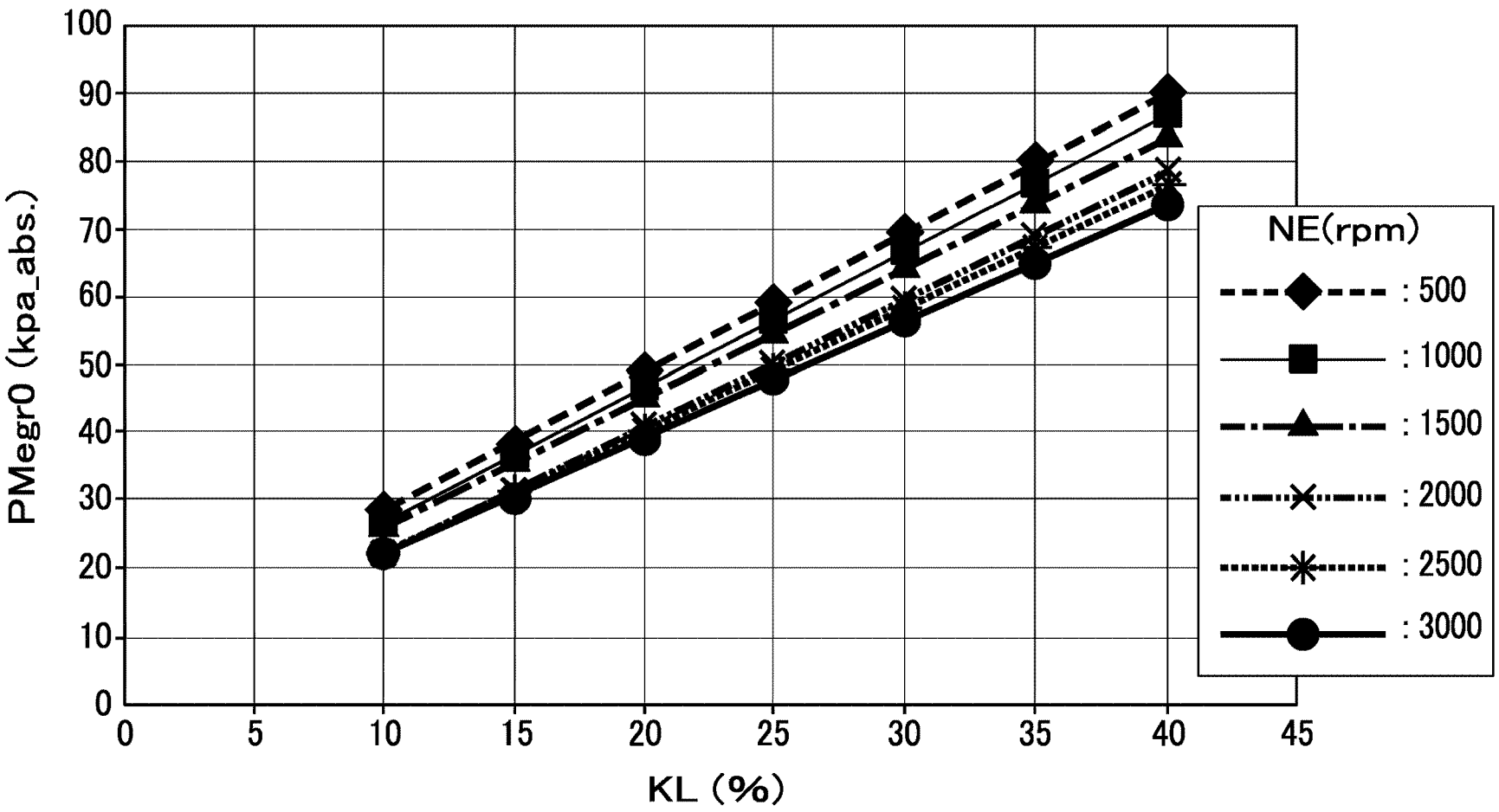
FIG. 5 is a fully-closing reference intake-pressure map referred to obtain the fully-closing reference intake pressure during deceleration according to an engine rotational speed and an engine load in the first embodiment.

In step 130, the ECU 50 takes in the fully-closing reference intake pressure PMegr0 during deceleration according to the engine rotational speed NE and the engine load KL. The ECU 50 can, for example, calculate the fully-closing reference intake pressure PMegr0 during deceleration according to the detected (obtained) engine rotational speed NE and the detected (obtained) engine load KL by referring to the fully-closing reference intake-pressure map which has been set in advance as shown in FIG. 5. This fully-closing reference intake-pressure map is a map which has been set a relation of the fully-closing reference intake pressure PMegr0 relative to the engine rotational speed NE and the engine load KL in advance when the open degree of the valve element 33 of the EGR valve 18 is "0", namely during the valve fully-closing operation. In general, the intake pressure PM during deceleration of the engine 1 is correlated to the engine load KL irrespective of presence or absence of the foreign-matter lodging in the EGR valve 18, and the both are almost proportional to each other. However, the intake pressure PM changes depending on the engine rotational speed NE, and thus in FIG. 5, the fully-closing reference intake pressure PMegr0 is set in line with the engine rotational speed NE and the engine load KL.

Subsequently, in step 140, the ECU 50 takes in an intake-pressure increase allowance α according to the engine rotational speed NE. The ECU 50 refers to a preset and predetermined intake-pressure increase allowance map, which has been set in advance, and can thereby calculate the intake-pressure increase allowance a according to the detected (obtained) engine rotational speed NE. This intake-pressure increase allowance α represents an increase amount of the intake pressure PM increases because the EGR valve 18 suffers from the valve-opening locking due to lodging of foreign matter FB during valve-closing control of the EGR valve 18, resulting in failure of valve-closing. Accordingly, the intake-pressure increase allowance a increases since an open degree of the EGR valve 18 becomes larger due to the foreign-matter lodging as a diameter of the foreign matter FB (a foreign-matter diameter) increases. Herein, the higher the engine rotational speed NE becomes, the less the EGR amount taken in the engine 1 per one rotation becomes, and thus the intake-pressure increase allowance α becomes small.

Subsequently, in step 150, the ECU 50 determines whether the detected (obtained) intake pressure PM is larger than an added result (PMegr0+α) of the fully-closing reference intake pressure PMegr0 and the intake-pressure increase allowance α. For this determination, the ECU 50 obtains the added result (PMegr0+α) by adding the intake-pressure increase allowance a to the fully-closing reference intake pressure PMegr0. The ECU 50 proceeds the process to step 160 when this determination result is affirmative, and proceeds the process to step 170 when the determination result is negative.

In step 160, the ECU 50 determines there is occurred abnormality due to the foreign-matter lodging in the EGR valve 18 (abnormality caused by occurrence of the foreign-matter lodging) and returns the process to step 100. The ECU 50 can store this determination result to a memory and carry out a determined abnormality notification control upon receipt of this determination result.

On the other hand, in step 170, the ECU 50 determines the EGR 18 is in normal state (normal since no foreign-matter lodging occurs) and returns the process to step 100.

According to the above-mentioned foreign-matter lodging diagnosis control, the ECU 50 calculates the fully-closing reference intake pressure PMegr0 (the reference intake pressure) according to the obtained engine rotational speed NE and the obtained engine load KL, calculates an intake-pressure increase allowance α according to the obtained engine rotational speed NE, adds the calculated intake-pressure increase allowance α to the calculated fully-closing reference intake pressure PMegr0, and then determines presence or absence of abnormality due to the foreign-matter lodging (valve-opening locking) in the EGR valve 18 based on the added result (PMegr0+α) and the obtained intake pressure PM.

(Operations and Effects of EGR Device of Engine)

According to the above-explained configuration of the EGR device of the engine in the present embodiment, during operation of the engine 1, the intake-pressure increase allowance α calculated according to the obtained engine rotational speed NE is added to the fully-closing reference intake pressure PMegr0 (the reference intake pressure) calculated according to the obtained engine rotational speed NE and the obtained engine load KL, and then presence or absence of the abnormality due to the foreign-matter lodging (valve-opening locking) in the EGR valve 18 is determined based on the added result (PMegr0+α) and the obtained intake pressure PM. Accordingly, the fully-closing reference intake pressure PMegr0 is calculated according to the various operation state of the engine 1, so that there is no need to limit the operation state of the engine 1 to any specific condition such as sonic in determining presence or absence of the abnormality due to the foreign-matter lodging in the EGR valve 18 and further no need to limit the motion state of the EGR valve 18 to a specific condition. Furthermore, for determination of presence or absence of the abnormality due to the foreign-matter lodging, the intake-pressure increase allowance a calculated according to the engine rotational speed NE is added to the fully-closing reference intake pressure PMegr0, and thus the increase amount of the intake pressure PM increased because the valve fails to be closed due to the foreign-matter lodging in the EGR valve 18 is reflected on determination of presence and absence of the abnormality due to the foreign-matter lodging. Therefore, it is possible to diagnose the abnormality due to the foreign-matter lodging (valve-opening locking) in the EGR valve 18 promptly and accurately without limiting the conditions related to the operation state of the engine 1 and the motion state of the EGR valve 18 to any specific condition.

Second Embodiment

Next, a second embodiment embodying an EGR device of an engine to a gasoline engine system is explained in detail with reference to the accompanying drawings.

In the following explanation, similar or identical components to those of the first embodiment are assigned with the same reference signs as those in the first embodiment and their explanations are omitted as appropriate, and thus the following explanation is made with a focus on the differences from the first embodiment. The present embodiment is different in its configuration from that of the first embodiment in a content of "foreign-matter lodging diagnosis control."

(Foreign-Matter Lodging Diagnosis Control)

Figure 6:
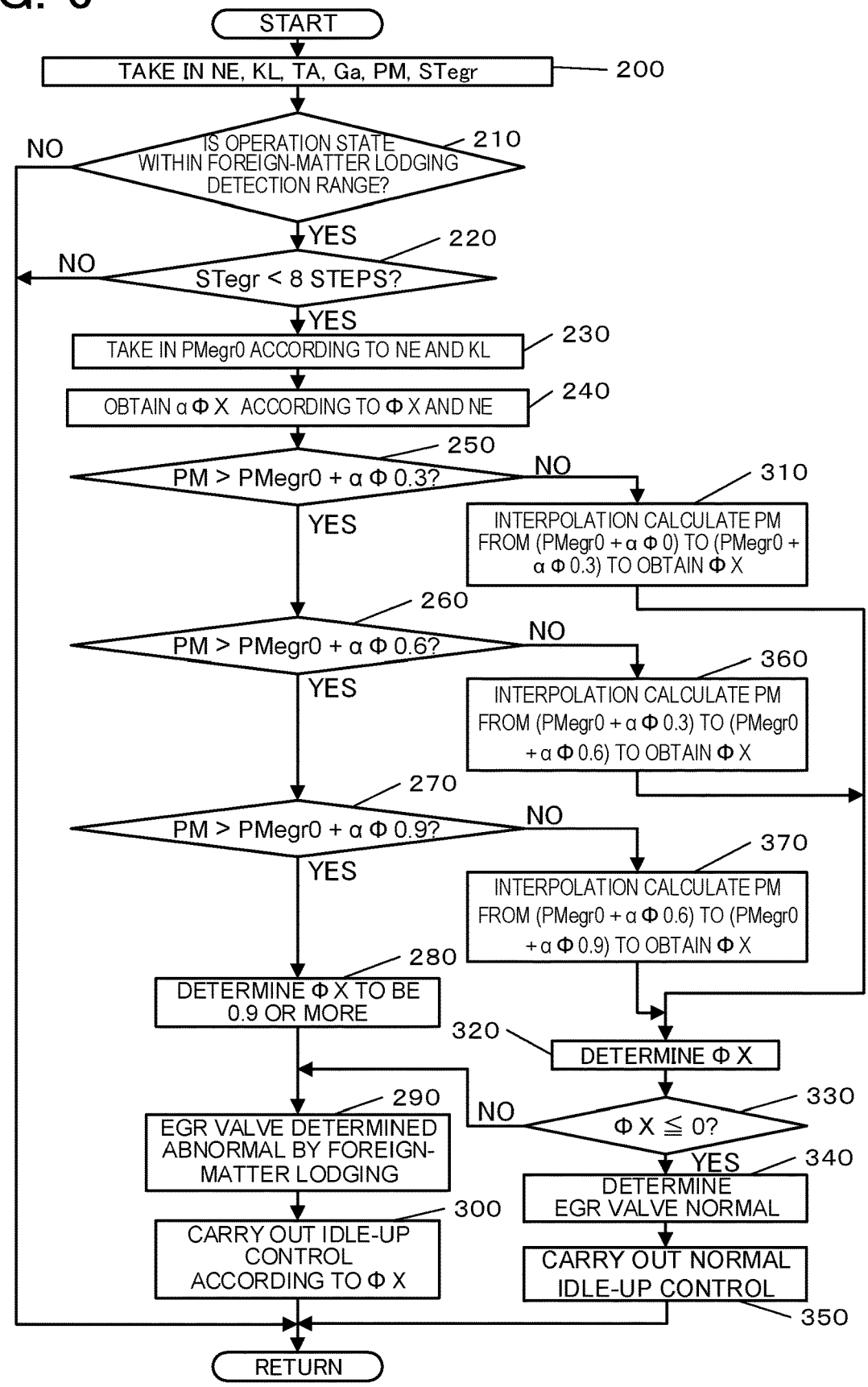
FIG. 6 is a flow chart indicating processing contents of the foreign-matter lodging diagnosis control in a second embodiment.

FIG. 6 is a flow chart showing one example of control contents of the "foreign-matter lodging diagnosis control" which is carried out by the ECU 50. This flow chart indicates the process of diagnosing abnormality due to the foreign-matter lodging (the valve-opening locking) in the EGR valve 18 during deceleration of engine 1 and the EGR valve 18 is controlled to be fully closed or closed.

When the process proceeds to this routine, firstly in step 200, the ECU 50 takes in each of the engine rotational speed NE, the engine load KL, the throttle open degree TA, the intake amount Ga, the intake pressure PM, and the number of motor steps STegr.

Subsequently, in step 210, the ECU 50 determines whether the operation state of the engine 1 is within the foreign-matter lodging detection range. The ECU 50 can, for example, determine whether a range defined by a relation of the engine rotational speed NE and the engine load KL is within a predetermined range appropriate for the foreign-matter lodging detection. As this predetermined range, deceleration operation or steady operation of the engine 1 is included. The ECU 50 proceeds the process to step 220 when this determination result is affirmative and returns the process to step 200 when the determination result is negative.

In step 220, the ECU 50 determines whether the number of motor steps STegr is less than "8 steps". The "8 steps" is one example and corresponds to a minute open degree of the EGR valve 18. The ECU 50 proceeds the process to step 230 when this determination result is affirmative, and returns the process to step 200 when the determination result is negative.

Figure 7:
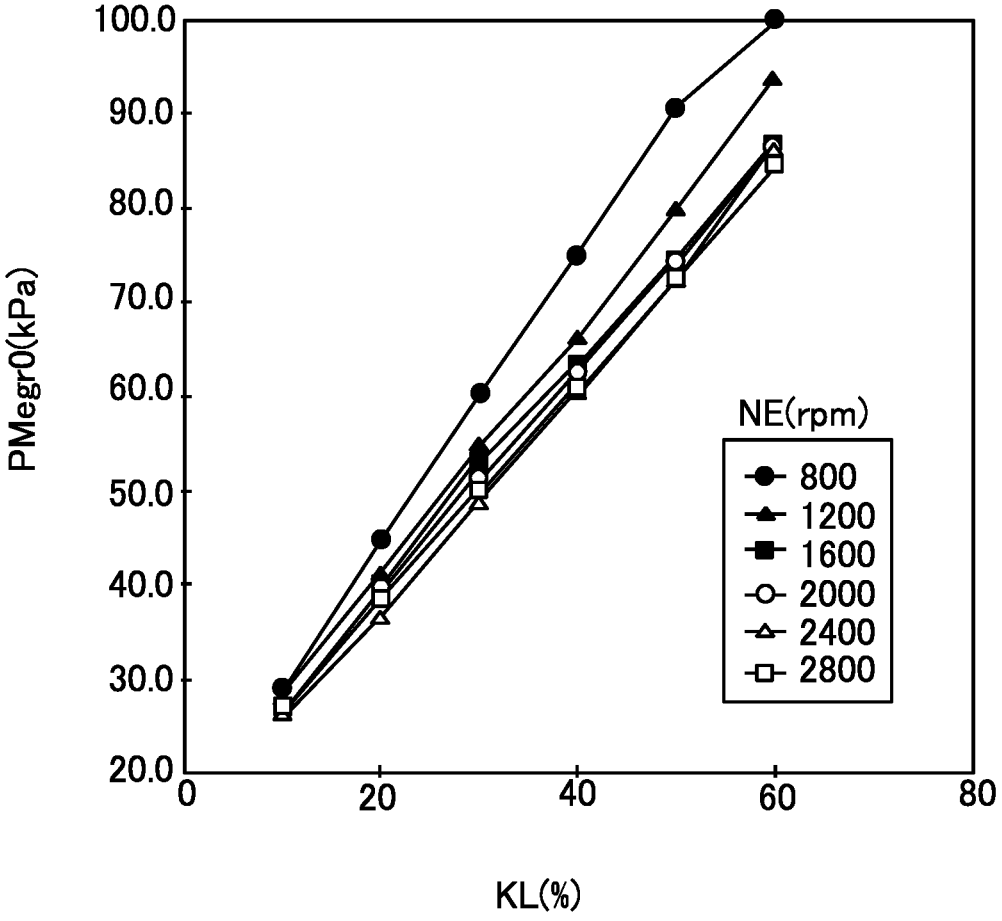
FIG. 7 is a fully-closing reference intake-pressure map referred to obtain a fully-closing reference intake pressure during deceleration according to an engine rotational speed and an engine load in the second embodiment.

In step 230, the ECU 50 takes in the fully-closing reference intake pressure PMegr0 during deceleration according to the engine rotational speed NE and the engine load KL. The ECU 50 can, for example, calculate the fully-closing reference intake pressure PMegr0 during deceleration according to the detected (obtained) engine rotational speed NE and the detected (obtained) engine load KL by referring to a preset fully-closing reference intake-pressure map shown in FIG. 7. Explanation for this fully-closing reference intake-pressure map is as similar to that of the fully-closing reference intake-pressure map in FIG. 5 in the first embodiment. Herein, the intake pressure PM becomes relatively lower as the engine rotational speed NE becomes higher, and thus in FIG. 7, the fully-closing reference intake pressure PMegr0 according to the engine rotational speed NE and the engine load KL has been set with considering the above-mentioned characteristics.

Figure 8:
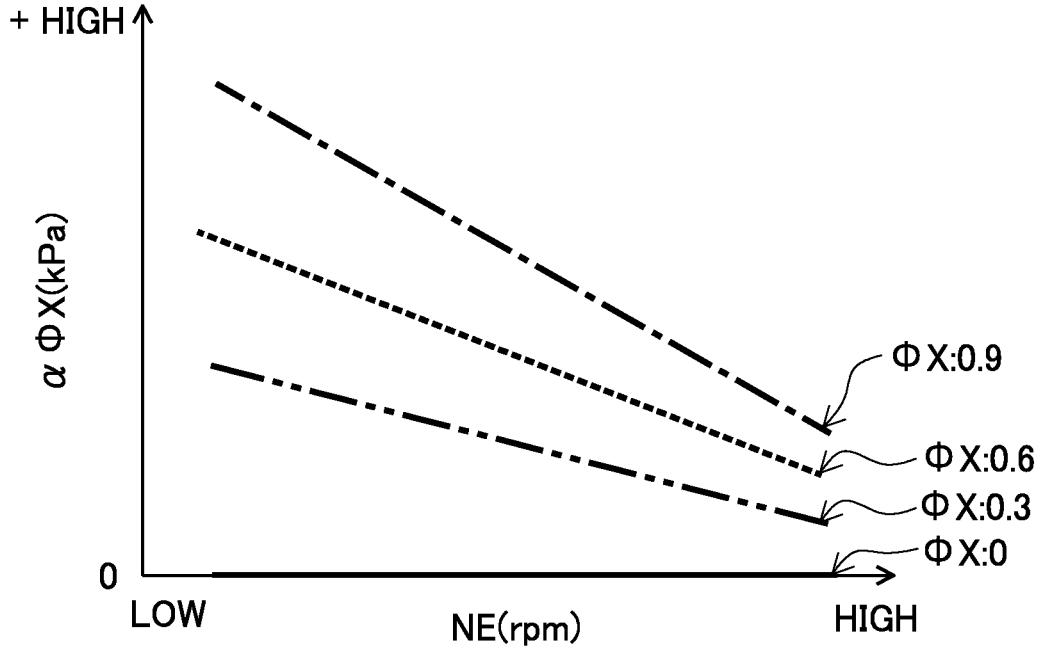
FIG. 8 is an intake-pressure increase-allowance map referred to obtain an intake-pressure increase allowance according to a diameter of a foreign matter lodged in the EGR valve and the engine rotational speed in the second embodiment.

Subsequently, in step 240, the ECU 50 obtains a diameter (a foreign-matter diameter) ΦX (X=0, 0.3, 0.6, 0.9) of the foreign matter FB that has been lodged in the EGR valve 18 and the intake-pressure increase allowance αΦX (X=0, 0.3, 0.6, 0.9) according to the engine rotational speed NE. The ECU 50 can, for example, calculate the intake-pressure increase allowance αΦDX according to the foreign-matter diameter ΦX and the detected (obtained) engine rotational speed NE by referring to a preset intake-pressure increase allowance map shown in FIG. 8. The intake-pressure increase allowance αΦX represents an increase amount of the intake pressure PM that is increased because the foreign matter FG has been lodged in the EGR valve 18 during valve-closing control of the EGR valve 18 to cause the valve-opening locking, and thus the EGR valve 18 fails to be closed. Accordingly, as shown in FIG. 8, the intake-pressure increase allowance αΦX increases as the foreign-matter diameter ΦX becomes larger, causing increase in the open degree of the EGR valve 18 due to the locking. Herein, the higher the engine rotational speed NE becomes, the less the amount of the EGR gas taken in the engine 1 per one rotation becomes, and thus the intake-pressure increase allowance αΦX becomes small. In FIG. 8, a bold chain-dot line represents a case of the foreign-matter diameter ΦX being "0.9 (mm)", a bold broken line represents a case of the foreign-matter diameter ΦX being "0.6 (mm)", a bold double-chain-dot line represents a case of the foreign-matter diameter ΦX being "0.3 (mm)", and a bold solid line represents a case of the foreign-matter diameter ΦX being "0 (mm)." Accordingly, in this embodiment, the intake-pressure increase allowance in the case of the foreign-matter diameter ΦX being "0 (mm)" is indicated as "αΦ0", the intake-pressure increase allowance in the case of the foreign-matter diameter ΦX being "0.3 (mm)" is indicated as "αΦ0.3", the intake-pressure increase allowance in the case of the foreign-matter diameter ΦX being "0.6 (mm)" is indicated as "αΦ0.6", and the intake-pressure increase allowance in the case of the foreign-matter diameter ΦX being "0.9 (mm)" is indicated as "αΦ0.9." Namely, in this step 240, the ECU 50 is arranged to calculate a plurality of the intake-pressure increase allowances αΦX (αΦ0, αΦ0.3, αΦ0.6, and αΦ0.9) according to a plurality of the foreign-matter diameters ΦX (Φ0, Φ0.3, Φ0.6, and Φ0.9) by which it is assumed that the foreign-matter lodging (the valve-opening locking) occurs in the EGR valve 18. This foreign-matter diameter ΦX corresponds to the open degree of the EGR valve 18 that is open due to the foreign-matter lodging.

Subsequently, in step 250, the ECU 50 determines whether the taken intake pressure PM is larger than the added result (PMegr0+αΦ0.3) of the fully-closing reference intake pressure PMegr0 and the intake-pressure increase allowance αΦ0.3. For this determination, the ECU 50 obtains the added result (PMegr0+αΦ0.3) by adding the intake-pressure increase allowance αΦ0.3 to the fully-closing reference intake pressure PMegr0. When this determination result is affirmative, the ECU 50 determines that the foreign-matter diameter ΦX is "equal to or larger than 0.3 (mm)" and thus proceeds the process to step 260, and when the determination result is negative, the ECU 50 determines that the foreign-matter diameter ΦX is "in a range of 0 to 0.3 (mm)" and thus proceeds the process to step 310.

In step 260, the ECU 50 determines whether the taken intake pressure PM is larger than the added result (PMegr0+αΦ0.6) of the fully-closing reference intake pressure PMegr0 and the intake-pressure increase allowance αΦ0.6. For this determination, the ECU 50 obtains the added result (PMegr0+αΦ0.6) by adding the intake-pressure increase allowance αΦ0.6 to the fully-closing reference intake pressure PMegr0. When this determination result is affirmative, the ECU 50 determines that the foreign-matter diameter ΦX is "equal to or larger than 0.6 (mm)" and thus proceeds the process to step 270, and when the determination result is negative, the ECU 50 determines that the foreign-matter diameter ΦX is "in a range of 0.3 to 0.6 (mm)" and thus proceeds the process to step 360.

In step 270, the ECU 50 determines whether the taken intake pressure PM is larger than the added result (PMegr0+αΦ0.9) of the fully-closing reference intake pressure PMegr0 and the intake-pressure increase allowance αΦ0.9. For this determination, the ECU 50 obtains the added result (PMegr0+αΦ0.9) by adding the intake-pressure increase allowance αΦ0.9 to the fully-closing reference intake pressure PMegr0. When this determination result is affirmative, the ECU 50 determines that the foreign-matter diameter ΦX is "equal to or larger than 0.9 (mm)" and thus proceeds the process to step 280, and when the determination result is negative, the ECU 50 determines that the foreign-matter diameter ΦX is "in a range of 0.6 to 0.9 (mm)" and thus proceeds the process to step 370.

In step 280, the ECU 50 determines that the foreign-matter diameter ΦX is "equal to or larger than 0.9 (mm)." In other words, the ECU 50 calculates the foreign matter diameter ΦX by the process in step 280 and the preceding steps and obtains a calculation result of being "equal to or larger than 0.9 (mm)".

Subsequently, in step 290, the ECU 50 determines that the EGR valve 18 has abnormality due to the foreign-matter lodging. The ECU 50 can store this determination result in a memory and performs a determined notification control to a driver.

Subsequently, in step 300, the ECU 50 carries out the idle-up control according to the determined foreign-matter diameter ΦX. In this case, the ECU 50 carries out the idle-up control according to the foreign-matter diameter ΦX of 0.9 (mm) or more. Specifically, during deceleration of the engine 1, when the foreign-matter lodging occurs in the EGR valve 18, unnecessary EGR gas could leak and flow into the engine 1, so that there may be caused misfire or degradation in drivability in the engine 1 or caused occurrence of engine stall. Those problems such as the engine stall tend to occur easily as the foreign-matter diameter ΦX becomes larger, in other words, the flow rate of the EGR gas flowing into the engine 1 increases more. To address this, in the present embodiment, the ECU 50 carries out the idle-up control according to the foreign-matter diameter ΦX in order to avoid those problems such as engine stall. Thereafter, the ECU 50 returns the process to step 200.

On the other hand, in step 310 proceeded from step 250, the ECU 50 obtains the foreign-matter diameter ΦX by performing interpolation calculation of the taken intake pressure PM from the added result (PMegr0+αΦ0) of the fully-closed reference intake pressure PMegr0 and the intake-pressure increase allowance αΦ0 to the added result (PMegr0+αΦ0.3) of the fully-closed reference intake pressure PMegr0 and the intake-pressure increase allowance αΦ0.3. Namely, the ECU 50 obtains an open degree among a plurality of the assumed foreign-matter diameters ΦX (Φ0, Φ0.3, Φ0.6, and Φ10.9) by performing the interpolation calculation between the two adjacent added results (PMegr0+αΦ0, PMegr0+αΦ0.3) values of which are close to each other among a plurality of the calculated added results (PMegr0+αΦX). The ECU 50 may adopt, for example, the following calculation formula 1 (F1) for the interpolation calculation.

$$\Phi X=\{1-(PMegr0+\alpha\Phi 0.3-PM)/(PMegr0+\alpha\Phi 0.3-PMegr0)\}*(\Phi 0.3-\Phi 0)+\Phi 0 \quad \text{(F1)}$$

Subsequently, in step 320, the ECU 50 determines the foreign-matter diameter ΦX as the value obtained in step directly before step 320. In this case, the ECU 50 determines that the foreign-matter diameter ΦX is within a range of "0 to 0.3 (mm)." In other words, the ECU 50 calculates the foreign-matter diameter ΦX by the interpolation calculation in or before step 320, so that the ECU 50 obtains a determined result.

Subsequently, in step 330, the ECU 50 determines whether the determined foreign-matter diameter ΦX is "0" or less. When this determination result is affirmative, the ECU 50 determines that there is no foreign-matter lodging and proceeds the process to step 340, and when the determination result is negative, the ECU 50 determines that the foreign-matter lodging occurs and proceeds the process to step 290, and then carries out the process in steps 290 and thereafter.

In step 340, the ECU 50 determines that there is no abnormality occurred in the EGR valve 18 due to the foreign-matter lodging and determines that the EGR valve 18 is normal. The ECU 50 can store this determination result in a memory.

Subsequently, in step 350, the ECU 50 carries out the idle-up control during normal state of the EGR valve 18. In other words, during deceleration of the engine 1 when the EGR valve 18 has no foreign-matter lodging, there is no possibility of occurrence of engine stall and others caused by the EGR gas inflow in the engine 1, and thus the ECU 50 carries out the usual idle-up control. Thereafter, the ECU 50 returns the process to step 200.

On the other hand, in step 360 proceeded from step 260, the ECU 50 obtains the foreign-matter diameter ΦX by performing interpolation calculation of the taken intake pressure PM from the added result (PMegr0+αΦ0.3) of the fully-closed reference intake pressure PMegr0 and the intake-pressure increase allowance αΦ0.3 to the added result (PMegr0+αΦ0.6) of the fully-closed reference intake pressure PMegr0 and the intake-pressure increase allowance αΦ0.6. Herein, the ECU 50 obtains the taken intake pressure PM by the interpolation calculation between the two adjacent added results (PMegr0+αΦ0.3, PMegr0+αΦ0.6), values of which are close to each other. The ECU 50 may adopt for example, the following calculation formula 2 (F2) for the interpolation calculation.

$$\Phi X=\{1-(PMegr0+\alpha\Phi 0.6-PM)/(PMegr0+\alpha\Phi 0.6-PMegr0-\alpha\Phi 0.3)\}*(\Phi 0.6-\Phi 0.3)+\Phi 0.3 \quad (F2)$$

Then, the ECU 50 proceeds the process to step 320 and carries out the process in steps 320 and thereafter.

On the other hand, in step 370 proceeded from step 270, the ECU 50 obtains the foreign-matter diameter ΦX by performing interpolation calculation of the taken intake pressure PM from the added result (PMegr0+αΦ0.6) of the fully-closed reference intake pressure PMegr0 and the intake-pressure increase allowance αΦ0.6 to the added result (PMegr0+αΦ0.9) of the fully-closed reference intake pressure PMegr0 and the intake-pressure increase allowance αΦ0.9. Herein, the ECU 50 obtains the taken intake pressure PM by the interpolation calculation between the two adjacent added results (PMegr0+αΦ0.6, PMegr0+αΦ0.9), values of which are close to each other. The ECU 50 may adopt for example, the following calculation formula 3 (F3) for the interpolation calculation.

$$\Phi X=\{1-(PMegr0+\alpha\Phi 0.9-PM)/(PMegr0+\alpha\Phi 0.9-PMegr0-\alpha\Phi 0.6)\}*(\Phi 0.9-\Phi 0.6)+\Phi 0.6 \quad (F3)$$

Then, the ECU 50 proceeds the process to step 320 and carries out the process in steps 320 and thereafter.

According to the above-mentioned foreign-matter lodging diagnosis control, the ECU 50 is arranged to calculate the fully-closing reference intake pressure PMegr0 (the reference intake pressure) according to the obtained engine rotational speed NE and the obtained engine load KL, to calculate the intake-pressure increase allowance αΦX according to the obtained engine rotational speed NE, to add the calculated intake-pressure increase allowance αΦX to the calculated fully-closing reference intake pressure PMegr0, and to determine presence or absence of abnormality in the EGR valve 18 due to the foreign-matter lodging (valve-opening locking) based on the added result (PMegr0+αΦX) and the obtained intake pressure PM.

According to the above-mentioned foreign-matter lodging diagnosis control, the ECU 50 is arranged to calculate the foreign-matter diameter ΦX (the open degree) of the EGR valve 18 based on the added result (PMegr0+αΦX) and the obtained intake pressure PM, to determine there occurs abnormality in the EGR valve 18 due to the foreign-matter lodging (valve-opening locking) when the calculated foreign-matter diameter ΦX of the EGR valve 18 is equal to or more than predetermined value (for example, "0.9") (or it may be set as "a case in which the value is larger than an almost zero"), and to determine no abnormality occurs in the EGR valve 18 due to the foreign-matter lodging when the calculated foreign-matter diameter ΦX of the EGR valve 18 becomes almost zero (or the value may be set as a case in which "the value becomes a predetermined value or less").

According to the above-mentioned foreign-matter lodging diagnosis control, the ECU 50 is arranged to calculate a plurality of the different intake pressure intake allowances αΦX according to a plurality of foreign-matter diameters ΦX (the open degrees) by which the foreign-matter lodging (the valve-opening locking) in the EGR valve 18 is assumed, to compare a plurality of different added results (PMegr0+αΦX) of each of a plurality of the calculated intake-pressure increase allowances αΦX and the calculated fully-closing reference intake pressure PMegr0 with the obtained intake pressure PM, and when the intake pressure PM is equal to or approximated to the added results (PMegr0+αΦX), to obtain the foreign-matter diameter ΦX (the open degree) according to the intake-pressure increase allowance αΦX that configures the added result (PMegr0+αΦX) concerning the determination as the foreign-matter diameter ΦX (the open degree) of lodging in the EGR valve 18.

According to the above-mentioned foreign-matter lodging diagnosis control, the ECU 50 is arranged to obtain the foreign-matter diameter ΦX (the open degree) between a plurality of the foreign-matter diameters ΦX (the open degrees) by performing the interpolation calculation of the obtained intake pressure PM between the adjacent two added results (PMegr0+αΦX) values of which are close to each other among a plurality of the calculated added results (PMegr0+αΦX).

(Operations and Effects of EGR Device of Engine)

According to the above-explained configuration of the EGR device of the engine in the present embodiment, during operation of the engine 1, the intake-pressure increase allowance αΦX that is calculated according to the obtained engine rotational speed NE is added to the fully-closing reference intake pressure PMegr0 (the reference intake pressure) that is calculated according to the obtained engine rotational speed NE and the obtained engine load KL, and presence or absence of abnormality in the EGR valve 18 due to the foreign-matter lodging (the valve-opening locking) is determined based on the added result (PMegr0+αΦX) and the obtained intake pressure PM. Accordingly, the fully-closing reference intake pressure PMegr0 according to the various operation state of the engine 1 is calculated, so that there is no need to limit the operation state of the engine 1 to any specific conditions such as sonic and no need to limit the motion state of the EGR valve 18 to any specific conditions in order to determine presence or absence of abnormality in the EGR valve 18 due to the foreign-matter lodging. Further, for determination of presence or absence of abnormality due to the foreign-matter lodging, the intake-pressure increase allowance αΦX that is calculated according to the engine rotational speed NE is added to the fully-closing reference intake pressure PMegr0, so that the increase amount of the intake pressure PM caused by failure in closing the EGR valve 18 due to the foreign-matter lodging is reflected on the determination of presence or absence of abnormality due to the foreign-matter lodging. Therefore, abnormality in the EGR valve 18 due to the foreign-matter lodging (the valve-opening locking) can be promptly and accurately diagnosed without limiting the conditions relative to the operation state of the engine 1 and the motion state of the EGR valve 18 to any specific conditions.

According to the configuration of the present embodiment, the foreign-matter diameter ΦX (the open degree) of the foreign matter FB lodged in the EGR valve 18 is calculated based on the added result of the fully-closing reference intake pressure PMegr0 and the intake-pressure increase allowance αΦX and the obtained intake pressure PM, and thereby presence or absence of abnormality in the EGR valve 18 due to the foreign-matter lodging (the valve-opening locking) is determined. Accordingly, the foreign-matter diameter ΦX of the foreign-matter lodging can be obtained through determination of presence or absence of abnormality due to the foreign-matte lodging. Therefore, the obtained foreign-matter diameter ΦX (the open degree) can be utilized for countermeasure control to the abnormality due to the foreign-matter lodging (the valve-opening locking). The present embodiment can be utilized for carrying out the idle-up control according to the foreign-matter diameter ΦX.

According to the configuration of the present embodiment, on the premise that the intake-pressure increase allowance αΦX changes as the foreign-matter diameter ΦX (the open degree) of the foreign-matter lodging (the valve-opening locking) in the EGR valve 18 changes, the foreign-matter diameter ΦX corresponding to each one of a plurality of the intake-pressure increase allowances αΦX assumed with the foreign-matter lodging is obtained as the foreign-matter diameter ΦX due to the foreign-matter lodging in the EGR valve 18. Accordingly, the foreign-matter diameter ΦX can be obtained with less variations. Therefore, the foreign-matter diameter ΦX (the open degree) with reference to the foreign-matter lodging (the valve-opening lodging) in the EGR valve 18 can be obtained highly accurately.

According to the configuration of the present embodiment, the foreign-matter diameter ΦX (an intermediate foreign-matter diameter) between the assumed plural foreign-matter diameters ΦX (the open degrees) can be obtained by the interpolation calculation of the adjacent two added results (PMegr0+αΦX), values of which are close to each other among a plurality of the added results (PMegr0+αΦX), and thus there is no need to store any data such as maps and formulas for calculating the intake-pressure increase allowance αΦX for obtaining the intermediate foreign-matter diameter. Accordingly, there is no need to memorize data such as an intake-pressure increase allowance map corresponding to all the foreign-matter diameters ΦX (the open degrees) to the memory of the ECU 50, thus achieving reduction in burden of the ECU 50.

Further, according to the configuration of the present embodiment, the idle-up control according to the foreign-matter diameter ΦX is carried out, and thus, even if the EGR gas leaks out of the EGR valve 18 to the engine 1 due to the foreign-matter lodging (the valve-opening locking), the intake amount to be taken into the engine 1 is increased and the EGR gas is appropriately diluted by the idle-up control. Accordingly, occurrence of misfire and engine stall in the engine 1 can be avoided.

The present disclosure is not limited to the above-mentioned embodiments and may be embodied with partly changing its configuration in an appropriate manner without departing from the scope of the disclosed technique.

(1) In the above respective embodiments, the ECU 50 is configured to calculate the fully-closing reference intake pressure PMegr0 according to the obtained engine rotational speed NE and the obtained engine load KL by referring to a predetermined fully-closing reference intake-pressure map. Alternatively, the ECU 50 may calculate the fully-closing reference intake pressure according to the obtained engine rotational speed and the obtained engine load by referring to a predetermined fully-closing reference function expression.

(2) In the above respective embodiments, the ECU 50 is configured to obtain the intake-pressure increase allowances α and αΦX according to the obtained engine rotational speed NE by referring to the predetermined intake-pressure increase allowance map. Alternatively, the ECU 50 may obtain the intake-pressure increase allowance according to the obtained engine rotational speed by referring to a function formula of a predetermined intake-pressure increase allowance.

(3) In the above respective embodiments, the EGR device of the engine is embodied as an EGR device of a so-called "high-pressure loop type" in a gasoline engine system with no supercharger provided. Alternatively, the EGR device may be embodied as an EGR device of a so-called "high-pressure loop type" or a "low-pressure loop type" in a gasoline engine system provided with a supercharger.

(4) In the above respective embodiments, the EGR device of the engine is applied to a gasoline engine system, but alternatively, this EGR device may be applied to a diesel engine system. In this case, even if abnormality in the EGR valve due to the foreign-matter lodging (abnormality due to valve-opening locking) is determined, the idle-up control for avoiding the engine stall or the like may be omitted.

(5) In the above respective embodiments, the ECU 50 is configured to obtain the intake pressure PM that is detected by the intake pressure sensor 51, but alternatively, the ECU 50 may be configured to obtain the intake pressure by estimating the intake pressure from the throttle open degree which is detected by the throttle sensor.

(6) In the above-mentioned second embodiment, the ECU 50 is configured to obtain the foreign-matter diameter ΦX (X=0, 0.3, 0.6, 0.9) of the foreign matter FB lodged in the EGR valve 18 and the intake-pressure increase allowance αΦX (X=0, 0.3, 0.6, 0.9) according to the engine rotational speed NE. Alternatively, the ECU 50 may be configured to obtain more specific foreign-matter diameter ΦX (X=0, 0.2, 0.4, 0.6, 0.8, 1.0) and more specific intake-pressure increase allowance αΦX (X=0, 0.2, 0.4, 0.6, 0.8, 1.0) according to the engine rotational speed NE, or may be configured to obtain rougher foreign-matter diameter ΦX (X=0, 0.4, 0.8) and rougher intake-pressure increase allowance αΦX (X=0, 0.4, 0.8) according to the engine rotational speed NE.

(7) In the above respective embodiments, abnormality due to the foreign-matter lodging in the EGR valve 18 is assumed as abnormality due to the valve-opening locking in the EGR valve 18, but alternatively, any abnormality caused by the reason that valve-opening is being kept and the valve fails to be fully closed due to any other reasons other than the foreign-matter lodging may be assumed.

(8) In the above-mentioned second embodiment, the ECU 50 determines there is no abnormality due to the foreign-matter lodging in the EGR valve 18 when the calculated open degree of the EGR valve 18 becomes "almost zero". Alternatively, the condition may be "a predetermined value or less" instead of the condition of "almost zero".

(9) In the above-mentioned second embodiment, the ECU 50 diagnoses the foreign-matter lodging based on the foreign-matter diameter ΦX lodged in the EGR valve 18, but not only by the foreign-matter diameter ΦX, the foreign-matter lodging may be diagnosed based on an open area between the valve element and the valve seat that is generated when a foreign matter is lodged.

(10) In the above-mentioned second embodiment, when it is determined in step 290 in FIG. 6 that there is abnormality due to the foreign-matter lodging, the determination result is memorized in a memory and a determined notification control is carried out, and when it is determined in step 340 that there is no abnormality due to the foreign-matter lodging occurred and it is normal, the determination result is memorized in the memory, but this memorization in the memory and the notification control may be omitted. In this case, the foreign-matter lodging (the valve-opening locking) occurs when the foreign-matter diameter ΦX is larger than "0", and it is clear that there is no foreign-matter lodging occurred when the foreign-matter diameter is almost zero. From this perception, processes in steps 290 and 340 of FIG. 6 may be omitted. In this case, too, the intake-pressure increase allowance calculated according to the engine rotational speed is added to the reference intake pressure in order to determine presence or absence of abnormality due to the valve-opening locking, and thus an increase amount of the intake pressure generated because the EGR valve fails to be closed due to the valve-opening locking is reflected on determination of presence or absence of abnormality due to the valve-opening locking. In this case, too, the similar effects to the above-mentioned second embodiment can be achieved.

(11) In the above-mentioned second embodiment, in steps 310, 360, and 370 in FIG. 6, the foreign-matter diameter ΦX is obtained by performing the interpolation calculation of the taken intake pressure PM from the added result (PMegr0+αΦX) of the fully-closing reference intake pressure PMegr0 and the intake-pressure increase allowance αΦX. Alternatively, the above interpolation calculation may be omitted by memorizing all values of the intake-pressure increase allowance αΦX with respect to all the assumed foreign-matter diameter ΦX. In this case, calculation accuracy of the foreign-matter diameter is improved.

(12) In the above-mentioned respective embodiments, during valve-closing control of the EGR valve 18, the ECU 50 is configured to calculate the open degree of the EGR valve 18 based on the obtained operation state of the engine 1, and to diagnose abnormality due to the valve-opening locking in the EGR valve 18 based on the calculated open degree, but alternatively, the ECU may be configured to diagnose other abnormality (for example, abnormality due to the valve-closing locking) in addition to the abnormality due to the valve-opening locking.

INDUSTRIAL APPLICABILITY

The present disclosure may be applied to EGR devices provided in a gasoline engine and a diesel engine.

REFERENCE SIGNS LIST

1 Engine
3 Intake passage
3*a* Surge tank
5 Exhaust passage
14 Electronic throttle device
17 EGR passage
18 EGR valve
21 Throttle valve
50 ECU (EGR valve abnormality diagnosis member)
PM Intake pressure
NE Engine rotational speed
KL Engine load
α Intake pressure increase allowance
αΦX Intake pressure increase allowance
PMegr0 Fully-closing reference intake pressure (reference intake pressure)
ΦX Foreign-matter diameter (open degree)

The invention claimed is:

1. An EGR device of an engine comprising:

an EGR passage in which a part of exhaust gas discharged from an engine to an exhaust passage flows from the exhaust passage to an intake passage as EGR gas to be recirculated in the engine;

an EGR valve configured to regulate a flow rate of the EGR gas in the EGR passage;

a throttle valve configured to regulate an inflow rate in the intake passage; and an EGR-valve abnormality diagnosis member configured to calculate a reference intake pressure based on an obtained operation state of the engine and to diagnose at least abnormality in the EGR valve due to valve-opening locking based on the calculated reference intake pressure during valve-closing control of the EGR valve, wherein the operation state of the engine includes an intake pressure in the intake passage downstream of the throttle valve, a rotational speed of the engine, and a load of the engine, and the EGR-valve abnormality diagnosis member is configured to calculate the reference intake pressure according to the obtained rotational speed and the obtained load, to calculate an intake-pressure increase allowance according to the obtained rotational speed, to add the calculated intake-pressure increase allowance to the calculated reference intake pressure, and to determine any one of presence and absence of the abnormality due to the valve-opening locking in the EGR valve based on an added result and the obtained intake pressure.

2. The EGR device of the engine according to claim 1, wherein the EGR-valve abnormality diagnosis member is configured to calculate an open degree of the EGR valve based on the added result and the obtained intake pressure, to determine that the EGR valve causes the abnormality due to the valve-opening locking when the calculated open degree of the EGR valve is equal to or larger than any one of a predetermined value and almost zero, and to determine that the EGR valve causes no abnormality due to the valve-opening locking when the calculated open degree of the EGR valve is equal to or less than any one of the predetermined value and almost zero.

3. The EGR device of the engine according to claim 2, wherein the EGR-valve abnormality diagnosis member is configured to calculate a plurality of the different intake-pressure increase allowances according to a plurality of open degrees that are assumed to be caused by the valve-opening locking in the EGR valve, to compare a plurality of different added results of each of a plurality of the calculated intake-pressure increase allowances and the calculated reference intake pressures with the obtained intake pressure, and when the obtained intake pressure is determined to be equal or approximated to a plurality of the calculated added results, to obtain the open degree according to the intake-pressure increase allowance constituting the added results related to the determination as an open degree of the EGR valve.

4. The EGR device of the engine according to claim 3, wherein the EGR valve abnormality diagnosis member obtains the open degree among a plurality of the assumed open degrees by performing interpolation calculation of the obtained intake pressure between the two adjacent added results, values of which are close to each other, among a plurality of the calculated added results.

5. An EGR device of an engine comprising:

an EGR passage in which a part of exhaust gas discharged from an engine to an exhaust passage flows from the exhaust passage to an intake passage as EGR gas to be recirculated in the engine;

an EGR valve configured to regulate a flow rate of the EGR gas in the EGR passage;

a throttle valve configured to regulate an inflow rate in the intake passage; and an EGR-valve abnormality diagnosis member to calculate an open degree of the EGR valve based on an obtained operation state of the engine and to diagnose abnormality at least due to valve-opening locking in the EGR valve based on the calculated open degree during valve-closing control of the EGR valve, wherein the operation state of the engine includes an intake pressure in the intake passage downstream of the throttle valve, a rotational speed of the engine, and a load of the engine, and the EGR-valve abnormality diagnosis member is configured to calculate a reference intake pressure according to the obtained rotational speed and the obtained load, to calculate an intake-pressure increase allowance according to the obtained rotational speed, to add the calculated intake-pressure increase allowance to the calculated reference intake pressure, and to calculate the open degree of the EGR valve based on an added result and the obtained intake pressure.

* * * * *